US008916996B2

(12) United States Patent
Aimi et al.

(10) Patent No.: US 8,916,996 B2
(45) Date of Patent: Dec. 23, 2014

(54) ELECTRICAL DISTRIBUTION SYSTEM

(75) Inventors: Marco Francesco Aimi, Niskayuna, NY (US); Arun Virupaksha Gowda, Rexford, NY (US); Jianjun Jiang, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 702 days.

(21) Appl. No.: 13/194,002

(22) Filed: Jul. 29, 2011

(65) Prior Publication Data

US 2013/0025934 A1 Jan. 31, 2013

(51) Int. Cl.

| | |
|---|---|
| ***H01B 7/30*** | (2006.01) |
| ***H01H 1/00*** | (2006.01) |
| ***H01H 9/40*** | (2006.01) |
| ***H01H 1/58*** | (2006.01) |
| *H01H 59/00* | (2006.01) |

(52) U.S. Cl.

CPC ..... *H01H 1/0036* (2013.01); *H01H 59/0009* (2013.01); *H01H 9/40* (2013.01); *H01H 1/58* (2013.01)

USPC ..... 307/147

(58) Field of Classification Search

USPC ..... 307/147; 257/638

See application file for complete search history.

(56) References Cited

U.S. PATENT DOCUMENTS

| | | | | |
|---|---|---|---|---|
| 6,876,085 | B1 * | 4/2005 | Handforth et al. | 257/775 |
| 7,348,865 | B2 * | 3/2008 | Carvalho et al. | 333/33 |
| 7,554,222 | B2 | 6/2009 | Kumfer et al. | |
| 7,633,725 | B2 | 12/2009 | Premerlani et al. | |
| 2002/0097110 | A1 * | 7/2002 | Khan et al. | 333/34 |
| 2004/0114868 | A1 * | 6/2004 | Roberson | 385/43 |
| 2006/0226930 | A1 * | 10/2006 | Carvalho et al. | 333/34 |
| 2007/0103376 | A1 * | 5/2007 | Goldberg et al. | 343/792.5 |
| 2008/0016496 | A1 | 1/2008 | Li et al. | |
| 2009/0027137 | A1 * | 1/2009 | Fjelstad et al. | 333/34 |
| 2012/0241984 | A9 * | 9/2012 | Pendse | 257/782 |

FOREIGN PATENT DOCUMENTS

| | | | |
|---|---|---|---|
| EP | 2053017 | A2 | 4/2009 |
| EP | 2398028 | A2 | 12/2011 |
| WO | 0180258 | A2 | 10/2001 |

OTHER PUBLICATIONS

Search Report and Written Opinion from corresponding EP Application No. 12178134.8-2214 dated Dec. 11, 2012.

* cited by examiner

*Primary Examiner* — Daniel Cavallari

(74) *Attorney, Agent, or Firm* — Robert M. McCarthy

(57) ABSTRACT

An apparatus, such as an electrical distribution system, is provided. The apparatus can include a first conductor and a second conductor. Multiple conduction paths can form parallel electrical connections along a connection span between the first and second conductors, with each of the conduction paths having a respectively similar nominal electrical resistance. The first and second conductors can have respective cross-sectional areas that decrease in opposing directions along said connection span.

20 Claims, 10 Drawing Sheets

ELECTRICAL DISTRIBUTION SYSTEM

BACKGROUND

Electrical distribution systems are systems that serve to distribute electrical energy, often times from a source, such as a voltage source, to one or more electrical loads. Electrical distribution systems can include, for example, a series of busbars that serve to carry large currents, other conductors, such as wires, configured to carry smaller currents, electrical switches and switchgear to allow the distribution of current amongst the various current carrying components (busbars, wires) to be selectively affected, energy storage devices (e.g., batteries, capacitors, etc.), and/or active and passive components, such as resistors, inductors, and transistors.

In some cases, an electrical distribution system may include multiple conductors connected in a parallel arrangement. By affecting a relatively uniform distribution of current through the parallel conductors, the overall current carrying capacity of the parallel conductors may be enhanced relative to a non-uniform current distribution.

BRIEF DESCRIPTION

In one aspect, an apparatus, such as an electrical distribution system, is provided. The apparatus can include a first conductor and a second conductor. Multiple conduction paths can form parallel electrical connections along a connection span between the first and second conductors, with each of the conduction paths having a respectively similar nominal electrical resistance. The first and second conductors can have respective cross-sectional areas that decrease in opposing directions along said connection span.

In another aspect, an apparatus, such as an electrical distribution system, is provided. The apparatus can include a first trace and a second trace. Multiple conduction paths can form parallel electrical connections along a connection span between the first and second traces, each of the conduction paths having a respectively similar nominal electrical resistance. The first and second traces can have respective cross-sectional areas that decrease in opposing directions along said connection span.

In yet another aspect, a method, for example, for fabricating an electrical distribution system, is provided. The method can include depositing a film on a substrate. The film can be patterned to form first and second traces. Multiple switches can be simultaneously microfabricated on the substrate, such that the switches are configured to form parallel electrical connections along a connection span between the first and second traces. The film can be patterned such that the first and second traces have respective cross-sectional areas that decrease in opposing directions along the connection span.

DRAWINGS

DETAILED DESCRIPTION

Figure 1:
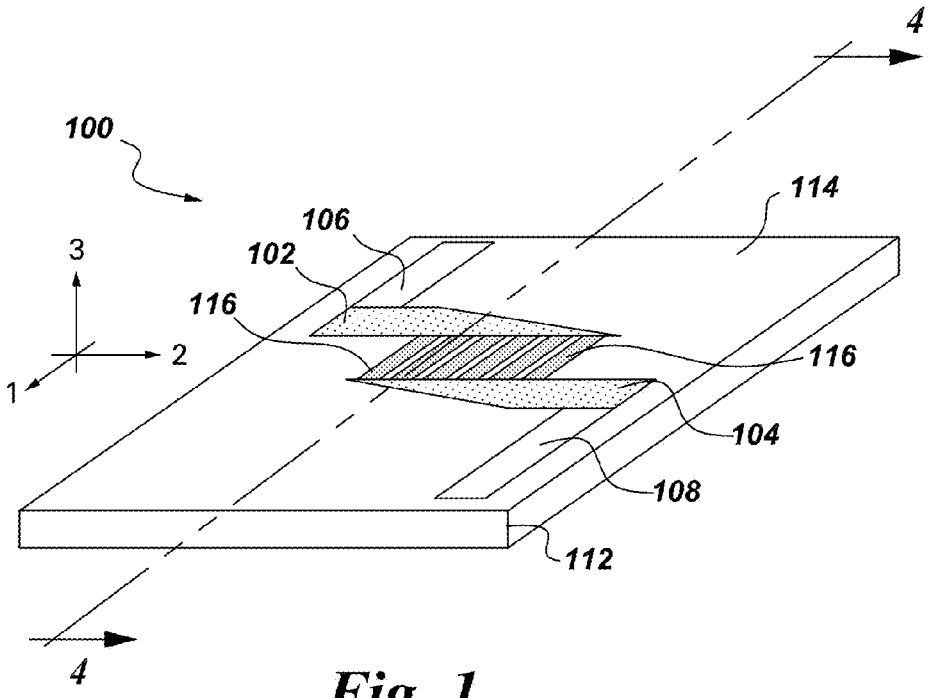
FIG. 1 is a perspective view of an electrical distribution system configured in accordance with an example embodiment.

Example embodiments are described below in detail with reference to the accompanying drawings, where the same reference numerals denote the same parts throughout the drawings. Some of these embodiments may address the above and other needs.

Referring to FIGS. 1-5, therein is shown an apparatus, such as an electrical distribution system 100. The system 100 can include a first conductor, such as a first trace 102, and a second conductor, such as a second trace 104. The first trace 102 can connect, for example, to an input bus 106, and the second trace 104 can connect to an output bus 108. The input and output buses 106, 108 can connect to opposing sides of an energy source, such as a voltage source 110. A substrate 112 can include a major surface 114 that acts to support the traces 102, 104 and the buses 106, 108. In one embodiment, the substrate 112 can include, for example, a silicon wafer, and the traces 102, 104 and/or buses 106, 108 can include metallizations (e.g., copper) with thicknesses (perpendicular to the substrate) in the micrometer to nanometer range and lateral dimensions in the millimeter to nanometer range.

Multiple conduction paths 116 may form parallel electrical connections between opposing lengths of the first and second traces 102, 104. For example, the first and second traces 102, 104 may be elongated along a length direction L that is parallel to the surface 114, and each of the conduction paths can respectively extend in a direction having a component orthogonal to the length direction. In this way, electrical power can be transmitted from the voltage source 110 through the input bus 106 to the first trace 102, and then through the conduction paths 116 to the second trace 104 and the output bus 108. The length along which the conduction paths 116 extend between opposing portions of the traces 102, 104 is referred to as the connection span 118. All of the conduction paths 116 can be configured to have respectively similar nominal electrical resistances. That is, assuming a similar configuration of the electrical input and output, each conduction path 116, analyzed individually, would be expected to exhibit a roughly similar electrical resistance.

Each of the conduction paths 116 can respectively include a switch 120. Each switch 120 may, for example, be what is commonly referred to as microelectromechanical system (MEMS) switch. The MEMS switches 120 can respectively include cantilevers 122 that extend from anchor structures 124 that connect to one trace 102. In some embodiments, the switches 120 (and the entireties of the conduction paths 116) can be formed of metal, such as copper. An actuation pad 126 can be configured to selectively receive an electrical charge, and can be disposed so as to cause, when charged, the cantilever 122 to be urged into contact with the other trace 104 due to an electrostatic force (this being referred to as the "closed" position of the switch, the alternative being the "open" position). The MEMS switches 120 can be substantially similar to one another. For example, MEMS switches are relatively small in scale and often formed through standard microfabrication techniques that allow for batch processing of multiple switches that are all substantially similar in construction. The MEMS switches 120 can be configured to be actuated together, and in this way, power can be selectively provided from the voltage source 110 through the conduction paths 116, with the array of switches acting as a "switch element."

Figure 5:
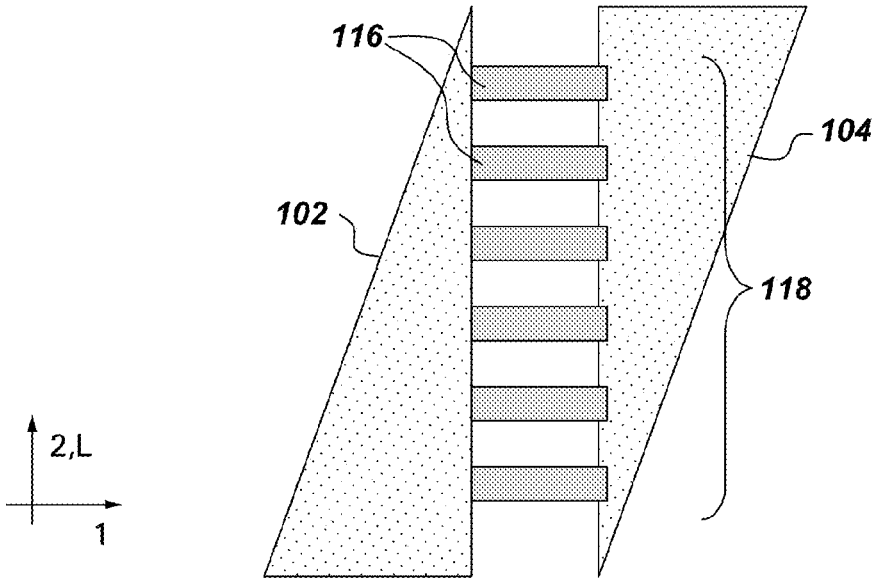
FIG. 5 is a plan view of the electrical distribution system of FIG. 1.
Figure 6:
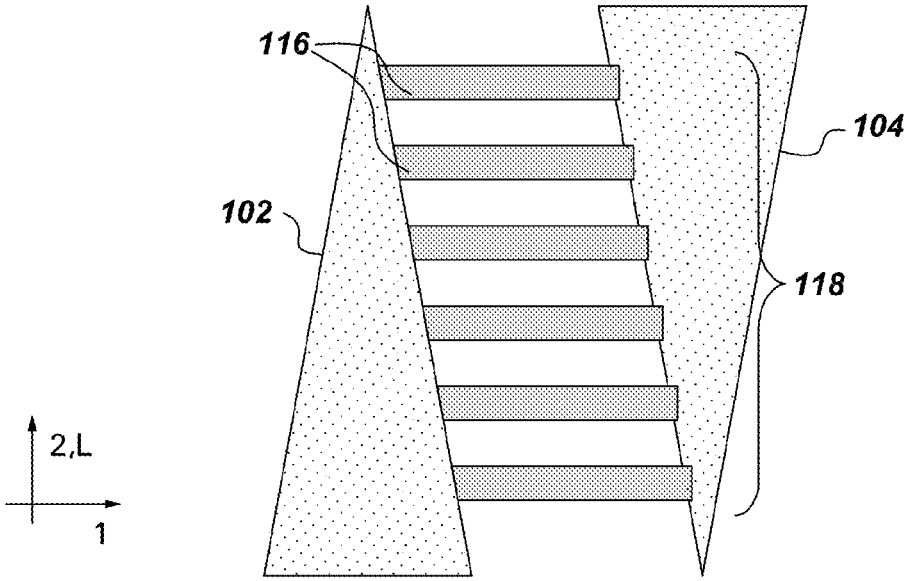
FIG. 6 is a plan view of an electrical distribution system configured in accordance with another example embodiment.
Figure 7:
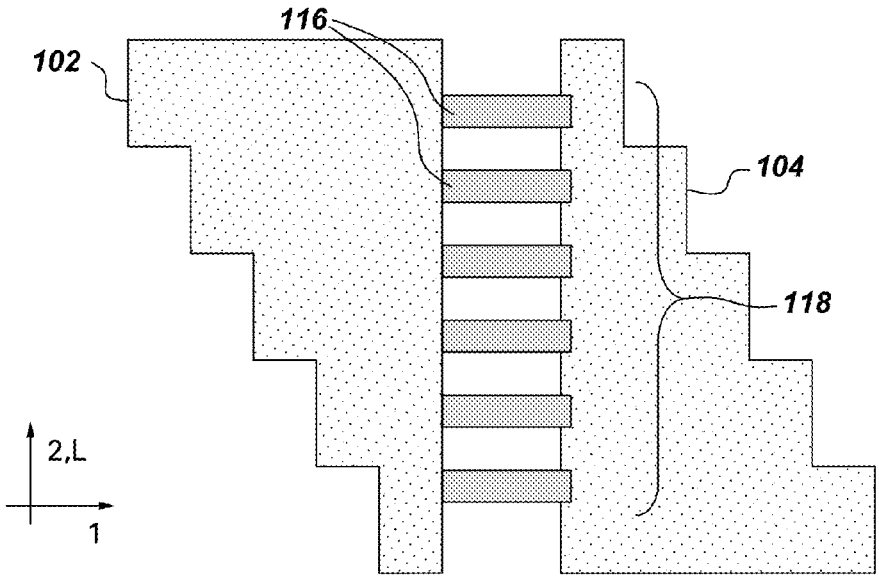
FIG. 7 is a plan view of an electrical distribution system configured in accordance with yet another example embodiment.

The traces 102, 104 can be configured to have respective cross-sectional areas A (taken transverse to the length direction L) that decrease in opposing directions along the connection span 118. For example, the traces 102, 104 may have constant thicknesses t (measured normally to the surface 114) and may have widths W (measured transversely to both the length direction L and the direction normal to the surface 114) that decrease in opposing directions along the connection span 118. In some embodiments, the widths W of the traces 102, 104 may decrease continuously along the connection span 118. For example, when viewing the traces 102, 104 along the direction normal to the surface 114, the traces can have a triangular shape (e.g., right triangles, as shown in FIGS. 1 and 5, equilateral triangles, as shown in FIG. 6, etc.). Referring to FIG. 7, in some embodiments, the widths W of the traces 102, 104 may decrease in discrete steps along the connection span 118. Overall, the shapes of the traces 102, 104 can be selected in a variety of ways to achieve the targeted decrease in cross sectional area A along the connection span 118, including utilizing traces of varying shape and/or thickness.

Figure 2:
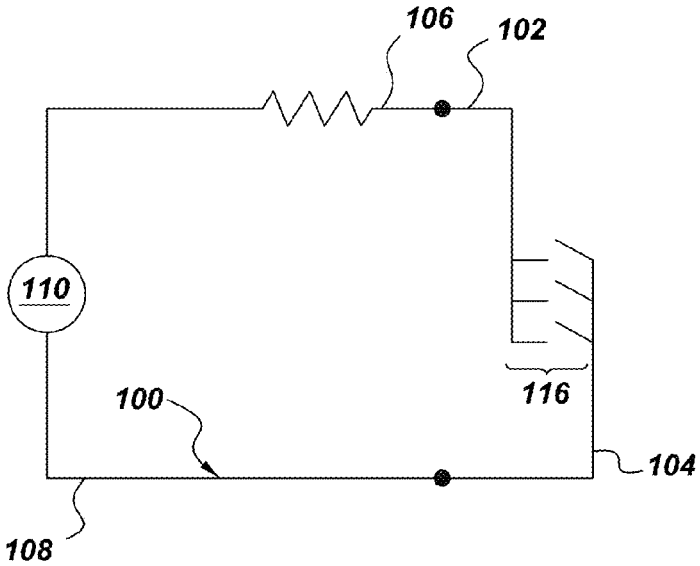
FIG. 2 is a circuit diagram of a circuit including the electrical distribution system of FIG. 1.
Figure 3:
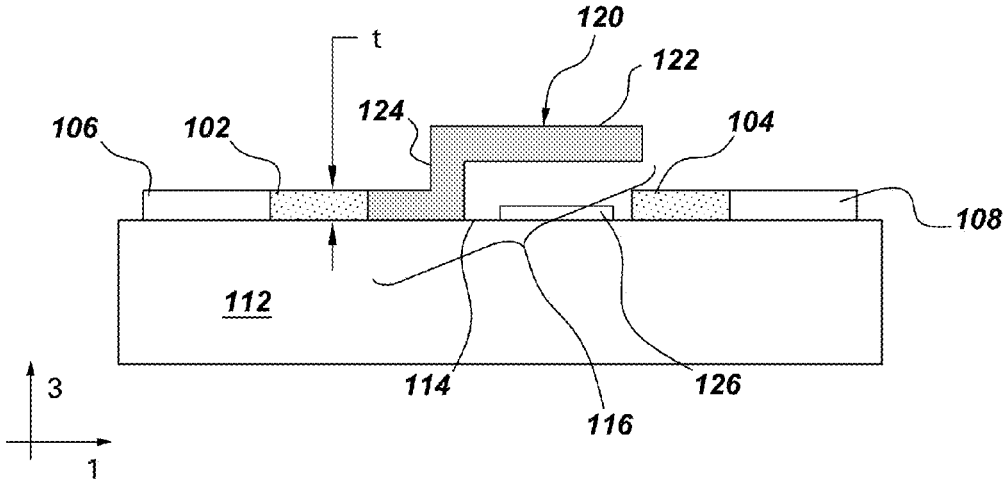
FIG. 3 is a side view of the electrical distribution system of FIG. 1.
Figure 4:
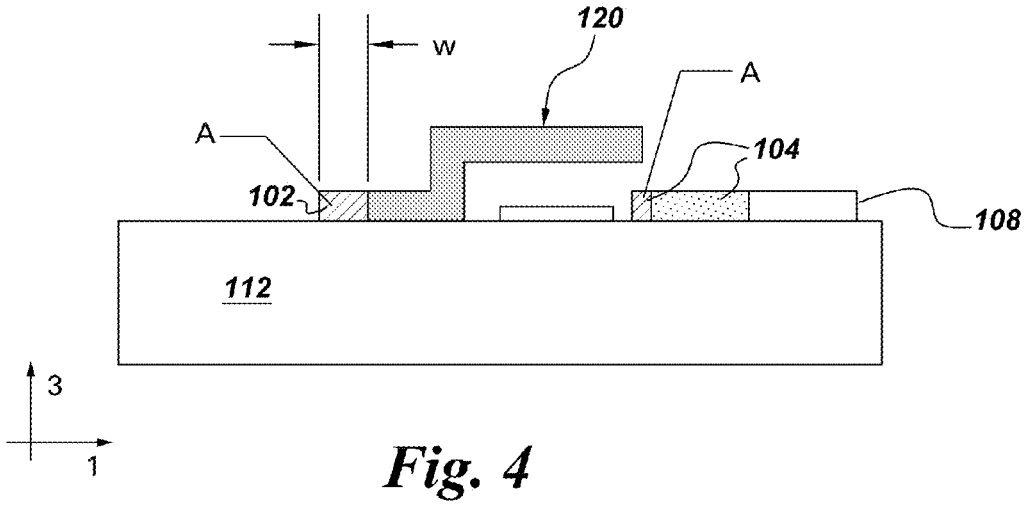
FIG. 4 is a cross sectional view of the electrical distribution system of FIG. 1, taken along the plane 4-4 of FIG. 1.
Figure 8:
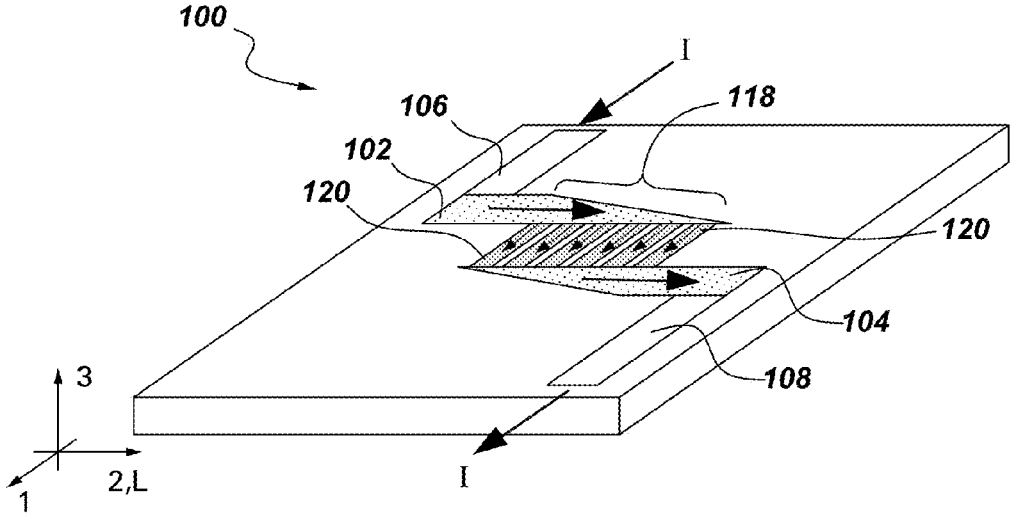
FIG. 8 is a perspective view of the electrical distribution system of FIG. 1, schematically depicting the current path therethrough.

Referring to FIGS. 2 and 8, as mentioned above, electrical power can be transmitted from the voltage source 110 through the input bus 106 to the first trace 102, and then through the switches 120 (when those switches are in the closed position) to the second trace 104 and the output bus 108. In such a case, an electrical current I can flow along the same path. The first trace 102 can have a cross-sectional area that decreases in the direction of current flow along the connection span 118. Alternatively, the second trace 104 can have a cross-sectional area that increases in the direction of current flow along the connection span 118.

Figure 9:
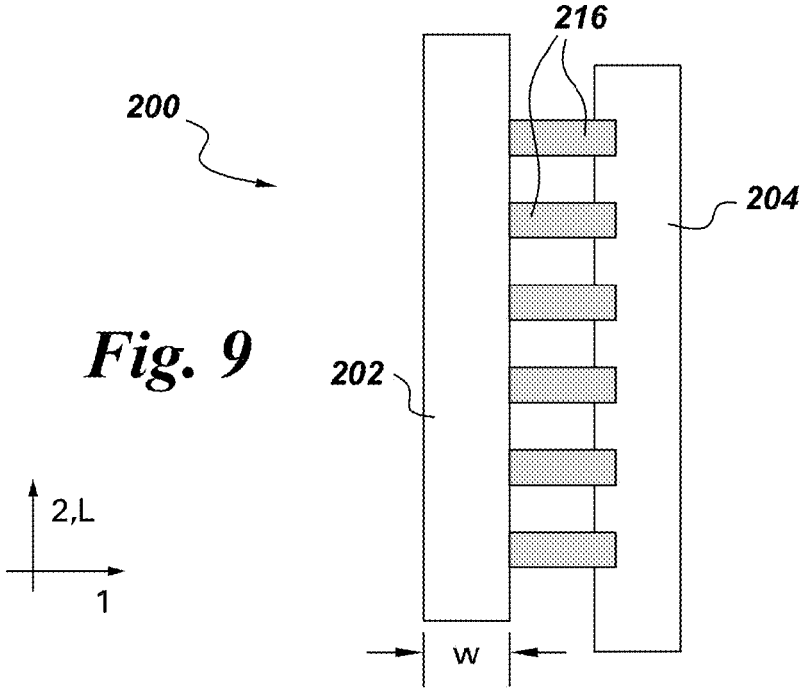
FIG. 9 is a plan view of a conventional electrical distribution system.

Electrical distribution systems configured in accordance with the above description (e.g., the electrical distribution system 100 of FIG. 1) may exhibit a more uniform distribution of electrical current therethrough than that exhibited by conventional electrical distribution systems. For example, referring to FIG. 9, therein is shown a portion of an electrical distribution system 200. The system 200 can include a first trace 202 that is configured to receive electrical current from an input bus (not shown), and a second trace 204 that is configured to deliver electrical current to an output bus (not shown). The traces may be formed of a conductive material, such as metal (e.g., copper). The traces 202, 204 may have widths W and thicknesses (measured out of the page in FIG. 9) that are roughly uniform, such that the cross sectional areas of the traces are relatively constant.

Figure 10:
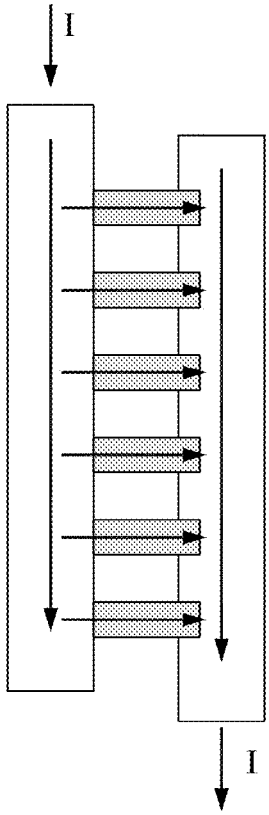
FIG. 10 is a plan view of the electrical distribution system of FIG. 9, schematically depicting the current path therethrough.

Multiple conduction paths 216 may form parallel electrical connections between opposing lengths of the first and second traces 202, 204. All of the conduction paths 216 can be configured to have respectively similar nominal electrical resistances (a typical scenario for conventional electrical distribution systems employing arrays of switches of similar construction). The conduction paths 216 can be formed, for example, of metal (e.g., copper). Referring to FIG. 10, in operation, current I can travel along the first trace 202, through the conduction paths 216, and then through the second trace 204. For such a system, where the resistivity of the conduction paths 216 is of about the same order of magnitude as that for the traces 202, 204 (e.g., where both the traces and conduction paths are formed of a metal such as copper), Applicants have discovered that current will tend to be distributed somewhat non-uniformly amongst the various conduction paths. This can limit the overall current carrying capacity of the array of conduction paths 216.

Figure 11:
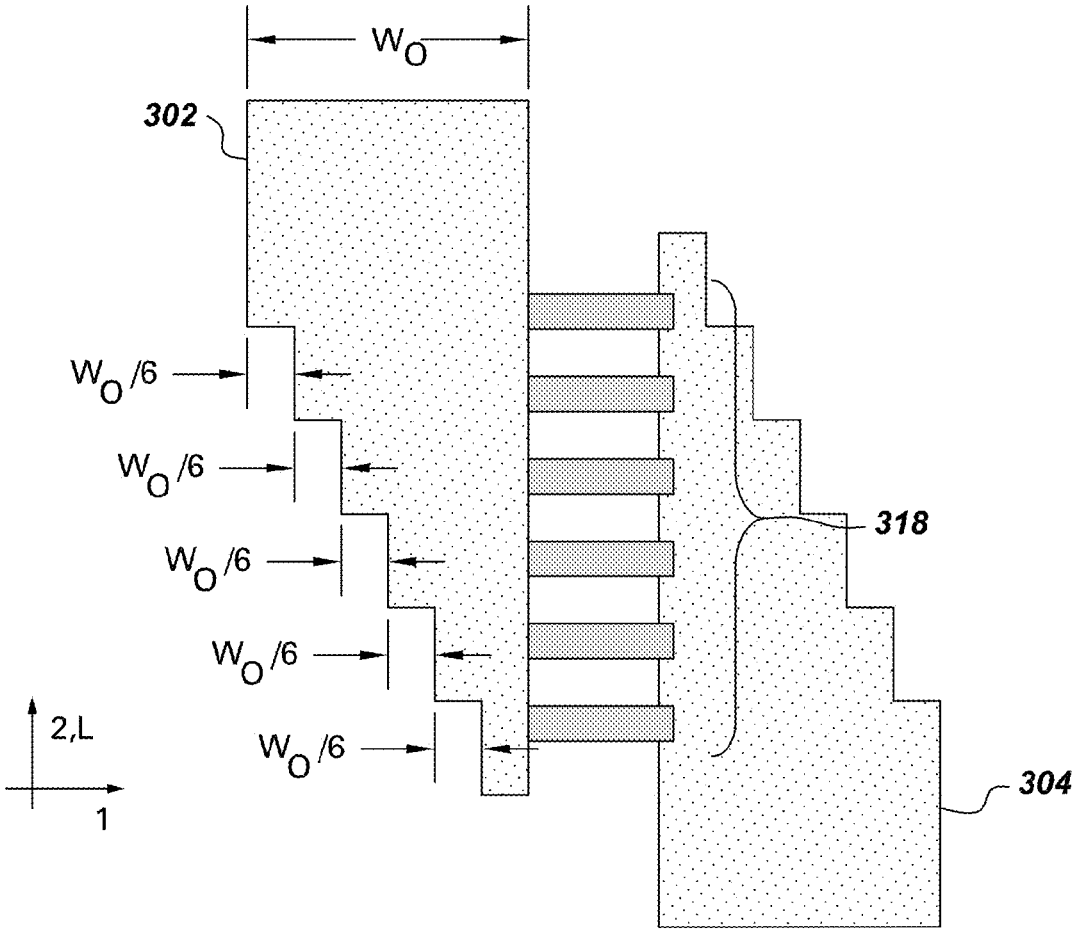
FIG. 11 is a plan view of an electrical distribution system configured in accordance with still another example embodiment.
Figure 12:
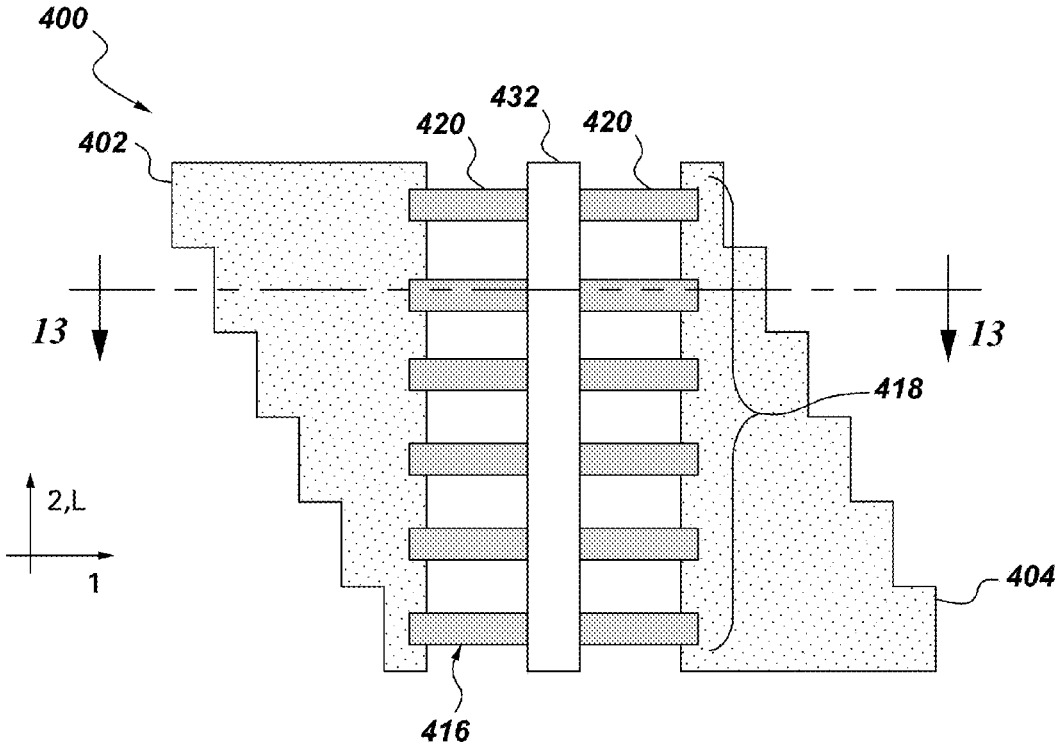
FIG. 12 is a plan view of an electrical distribution system configured in accordance with yet another example embodiment.

In contrast to the electrical distribution system 200, Applicants have found that by appropriately configuring the shapes of the traces to produce traces with cross-sectional areas that decrease in opposing directions along the connection span, a more uniform current distribution through the respective conduction paths can be achieved. For example, referring to FIG. 11, therein is shown an electrical distribution system 300 configured in accordance with another example embodiment. The electrical distribution system 300 can include traces 302, 304 and conduction paths 316 that connect the traces along a connection span 318. The traces 302, 304 can have constant thicknesses (measured out of the page in FIG. 11) and can have widths W that decrease in opposing directions along the connection span. The electrical distribution system 300 can have a number N of conduction paths (in FIG. 11, N=6). At each end 330 of the connection span 318, a respective one of the traces 302, 304 can have a width $W_0$. Further, the traces 302, 304 can have widths that decrease by an amount $W_0/N$ when moving from one conduction path 316 to an adjacent conduction path along the connection span 318. For example, considering specific conduction paths 316*a* and 316*b*, the width of the first trace 302 decreases by $W_0/6$ when moving from conduction path 316*a* to conduction path 316*b*, and the width of the second trace 304 decreases by $W_0/6$ when moving from conduction path conduction path 316*b* to conduction path 316*a*. This decrease in trace width could be continuous along the connection span 318 (e.g., as depicted in FIG. 5) or could be accomplished in discrete increments (as shown in FIG. 11). Other rates of decrease of the cross-sectional area of the traces 302, 304 are also possible, and the rate chosen will depend on the electrical characteristics of the system 300 as well as any limitations on circuit layout (e.g., routing requirements where the electrical distribution system is part of an integrated circuit).

The shaping of the traces 302, 304 to induce a more uniform distribution of current through the conduction paths 316 may become more important when the effective resistance of the conduction paths is smaller than or of the same order of magnitude as the traces. That is, where the conduction paths 316 present a relatively high resistance, current will flow quickly along the traces 302, 304 and will be distributed fairly evenly amongst the conduction paths. But, where the resistance presented by the conduction paths 316 is similar to or less than the resistance presented by the traces 302, 304, current may flow through the conduction paths without being fully distributed along the traces.

Figure 14:
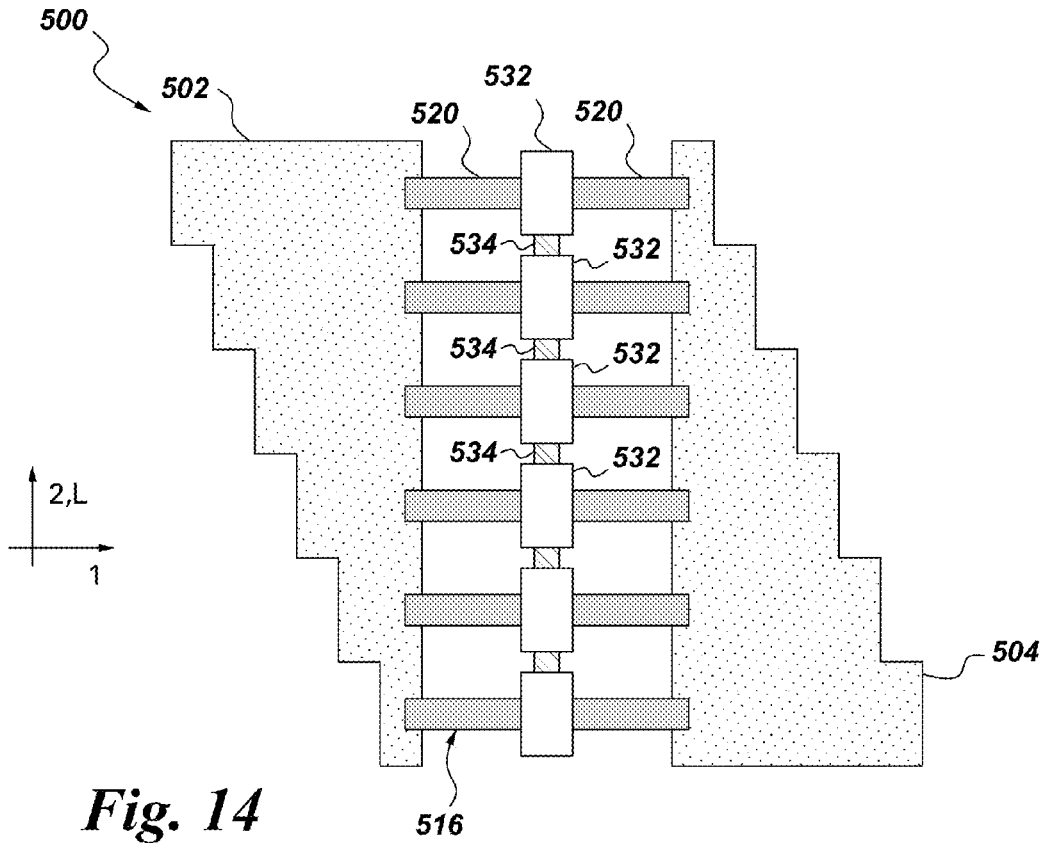
FIG. 14 is a plan view of an electrical distribution system configured in accordance with still another example embodiment.
Figure 15:
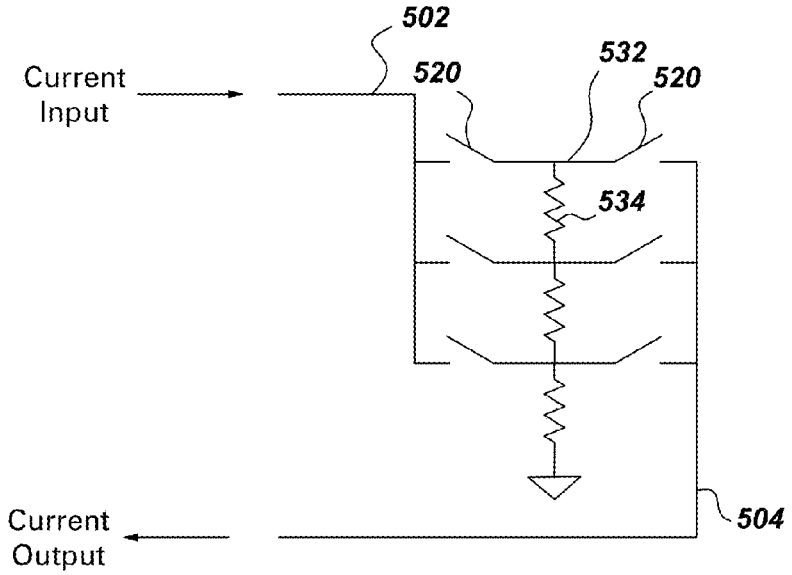
FIG. 15 is a circuit diagram of the electrical distribution system of FIG. 14.

Referring to FIGS. 14 and 15, therein are shown several views of an electrical distribution system 400 configured in accordance with another example embodiment. The electrical distribution system 400 can include traces 402, 404 and conduction paths 416 that connect the traces along a connection span 418. Each of the conduction paths 416 can include a pair of switches, for example, substantially similar MEMS switches 420. The MEMS switches 420 can respectively include cantilevers 422 that extend from anchor structures 424.

Figure 13:
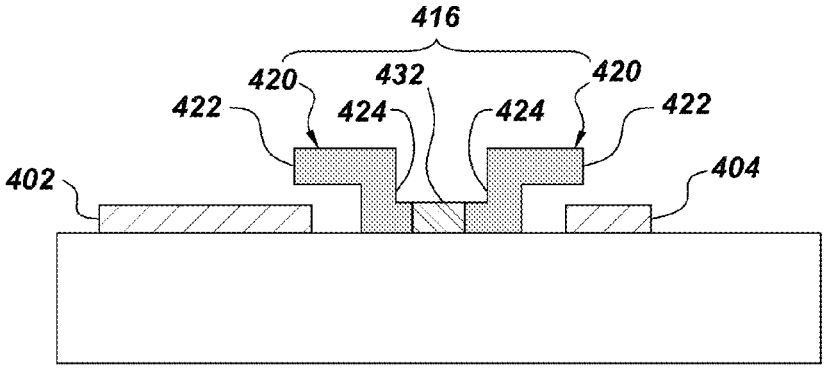
FIG. 13 is a cross sectional view of the electrical distribution system of FIG. 12 taken along line 13-13 of FIG. 12.

The switches 420 of each conduction path 416 can be electrically connected in series (e.g., in the "back-to-back" configuration depicted in FIG. 13, wherein the anchor structures 424 are included in an intermediate conductor 432) and configured to be actuated together. The intermediate conductor 432 can serve to respectively interconnect the various MEMS switches 420, and can also selectively (e.g., through a switch) connect to ground (connection not shown) to avoid the accumulation of electrical charge in the conduction paths 416 when both switches 420 are open, each of the conduction paths 416 is electrically isolated from the traces 402, 404 and the balance of the electrical distribution system 400. Referring to FIGS. 14 and 15, in some embodiments, each pair of MEMS switches 520 that extends between traces 502, 504 can be interconnected by a respective intermediate conductor 532, with adjacent intermediate conductors being electrically connected by regions of increased resistance 534. By introducing the regions of increased resistance 534, a majority of the current can be directed through the traces 502, 504, rather than through the intermediate conductors 532, when the switches 520 are in the closed position.

Figure 16:
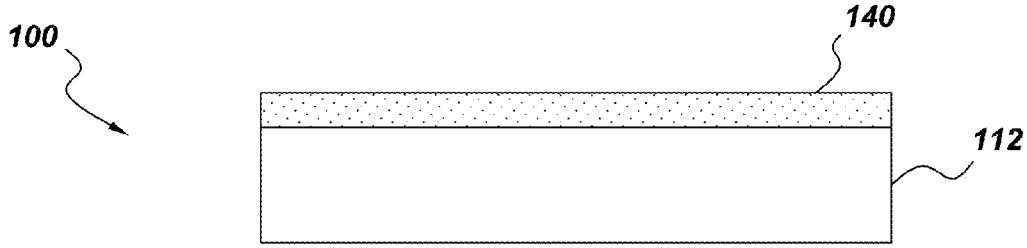
FIGS. 16-21 are schematic side views representing a method of fabricating the electrical distribution system of FIG. 1.
Figure 17:
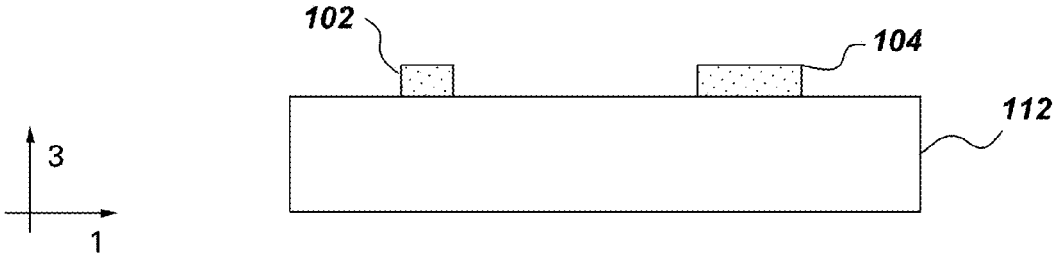
Figure 18:
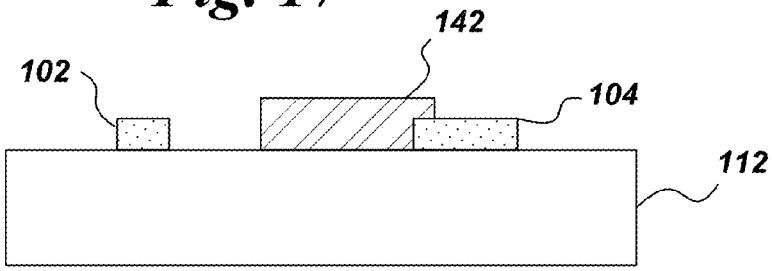
Figure 19:
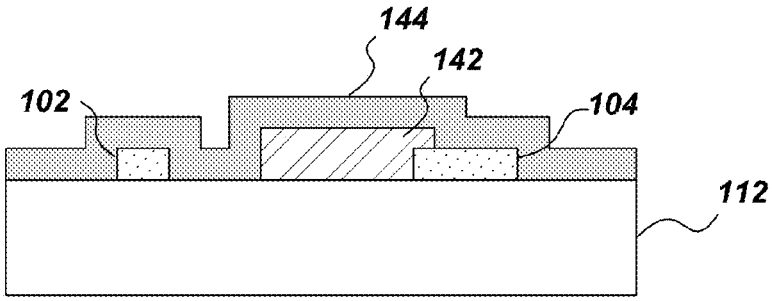
Figure 20:
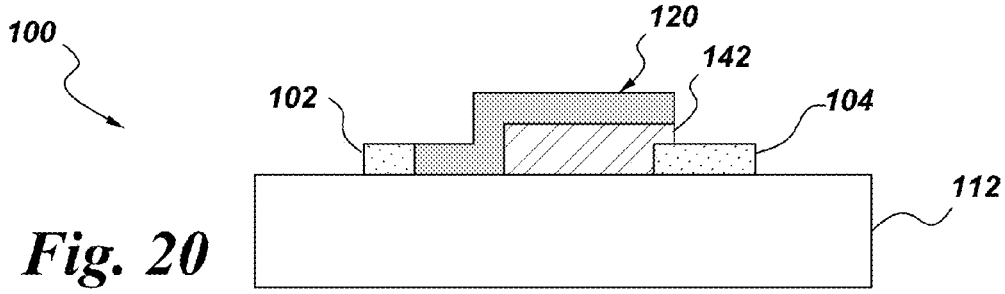
Figure 21:
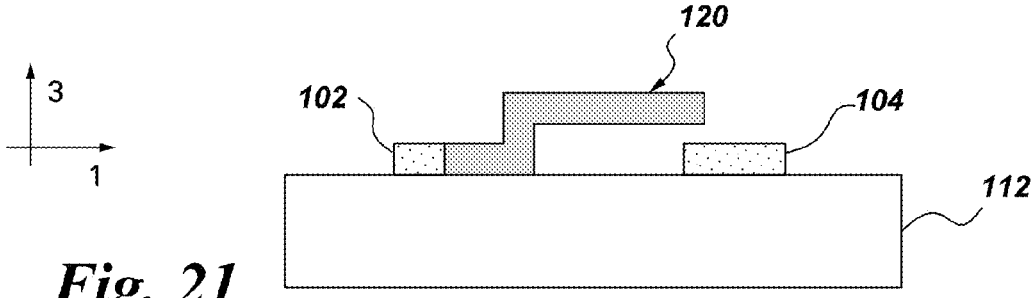

Referring to FIG. 1, as mentioned above, many of the various components of the electrical distribution system 100, including the traces 102, 104, buses 106, 108, and MEMS switches 120, may be formed via standard microfabrication techniques, including thin film deposition and/or growth, photolithography, and film patterning through preferential growth and/or etching. In this way, it may be possible to use batch processing to form the traces 102, 104 at one time so as to have a uniform thickness, and to fabricate the switches 120 together such that all of the switches in an array of switches are substantially similar in terms of geometry and composition. For example, referring to FIGS. 1 and 16-21, a process for fabricating the electrical distribution system 100 can begin by depositing, for example, via physical or chemical vapor deposition, a film 140 on a substrate 112 (e.g., see FIG. 16). In one embodiment, the film 140 may be a metal film, such as copper. The film 140 can be patterned, for example, via photolithography, to form first and second traces 102, 104 that have respective cross-sectional areas that decrease in opposing directions (e.g., see FIG. 17). Multiple MEMS switches 120 can be simultaneously microfabricated on the substrate, either prior to or subsequent to the traces 102, 104. For example, a sacrificial layer 142 can be patterned (e.g., see FIG. 18), and a film 144 can be deposited over the sacrificial layer (e.g., see FIG. 19). The film 144 can be patterned to form the switches 120 (e.g., see FIG. 20), which can be configured to form parallel electrical connections along the connection span 118 between the first and second traces 102, 104. Thereafter, the sacrificial layer 142 can be removed (e.g., see FIG. 21).

Figure 22:
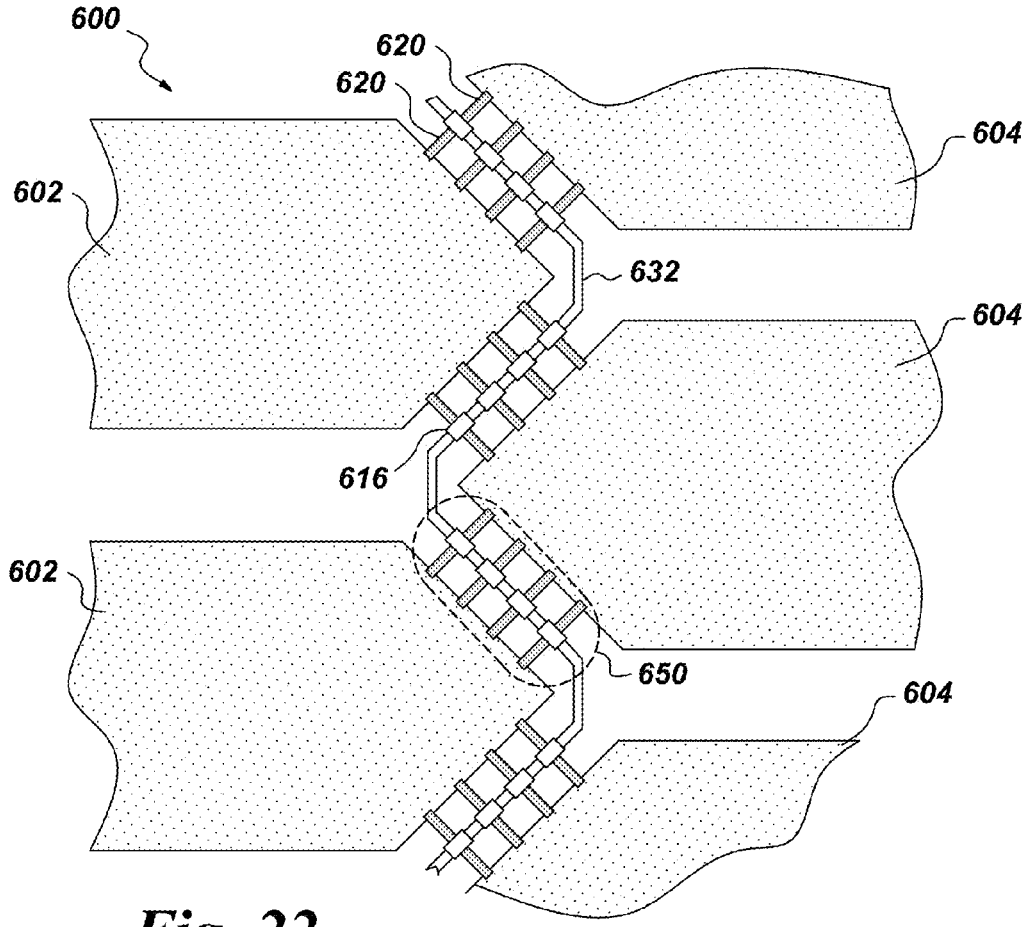
FIG. 22 is a plan view of an electrical distribution system configured in accordance with yet another example embodiment.

While only certain features of the invention have been illustrated and described herein, many modifications and changes will occur to those skilled in the art. For example, while the above discussion has focused on a single pair of traces that is interconnected by an array of conduction paths, referring to FIG. 22, in some embodiments, an array of traces 602, 604 may be interconnected, with each set of adjacent traces 602, 604 being connected by multiple conduction paths 616 arranged as an array 650. Each of the conduction paths 616 can include a pair of switches 620 arranged in a back-to-back configuration. A single intermediate conductor 632 can serve to interconnect all of the switches 620 of all of the arrays 650. It is, therefore, to be understood that the appended claims are intended to cover all such modifications and changes as fall within the true spirit of the invention.

What is claimed:

1. An apparatus comprising:

a first conductor;

a second conductor; and multiple conduction paths forming parallel electrical connections along a connection span between said first and second conductors, each of said conduction paths having a respectively similar nominal electrical resistance, wherein said first and second conductors have respective cross-sectional areas that decrease in opposing directions along said connection span.

2. The apparatus of claim 1, wherein said multiple conduction paths consist of a number N of conduction paths, and said first and second conductors have respective cross-sectional areas that decrease by an amount A/N when moving from one conduction path to an adjacent conduction path along said connection span, where A is a respective cross sectional area magnitude of said first and second conductors at an end of said connection span.

3. The apparatus of claim 1, wherein said first and second conductors and said conduction paths are configured to selectively carry current such that current selectively flows from said first conductor to said second conductor, and wherein said first conductor has a cross-sectional area that decreases in a direction of current flow along said connection span and said second conductor has a cross-sectional area that increases in a direction of current flow along said connection span.

4. The apparatus of claim 1, wherein each of said first and second conductors has a respective first and second resistivity and at least one of said conduction paths has a path resistivity that is less than or about equal to 10 times the first resistivity and to 10 times the second resistivity.

5. The apparatus of claim 1, wherein said first and second conductors are elongated along a length direction, and each of said conduction paths respectively extends in a direction having a component orthogonal to the length direction.

6. The apparatus of claim 1, wherein each of said conduction paths respectively includes a switch.

7. The apparatus of claim 6, wherein said switches are configured to be actuated together.

8. An apparatus comprising:

a first trace;

a second trace; and multiple conduction paths forming parallel electrical connections along a connection span between said first and second traces, each of said conduction paths having a respectively similar nominal electrical resistance, wherein said first and second traces have respective cross-sectional areas that decrease in opposing directions along said connection span.

9. The apparatus of claim 8, wherein said multiple conduction paths consist of a number N of conduction paths, and said first and second traces have respective cross-sectional areas that decrease by an amount A/N when moving from one conduction path to an adjacent conduction path along said connection span, where A is a respective cross sectional area magnitude of said first and second traces at an end of said connection span.

10. The apparatus of claim 8, wherein said first and second traces and said conduction paths are configured to selectively carry current such that current selectively flows from said first trace to said second trace, and wherein said first trace has a cross-sectional area that decreases in a direction of current flow along said connection span and said second trace has a cross-sectional area that increases in a direction of current flow along said connection span.

11. The apparatus of claim 8, wherein each of said first and second traces has a respective first and second resistivity and at least one of said conduction paths has a path resistivity that is less than or about equal to 10 times the first resistivity and to 10 times the second resistivity.

12. The apparatus of claim 8, wherein said first and second traces are elongated along a length direction, and each of said conductive paths respectively extends in a direction having a component orthogonal to the length direction.

13. The apparatus of claim 8, wherein said conduction paths each respectively include substantially similar MEMS switches.

14. The apparatus of claim 8, wherein said conduction paths each respectively include a pair of substantially similar MEMS switches that are electrically connected in series and configured to be actuated together.

15. The apparatus of claim 14, further comprising intermediate conductors that respectively interconnect each pair of MEMS switches, wherein said intermediate conductors are respectively separated by regions of increased resistance.

16. The apparatus of claim 15, wherein said MEMS switches respectively include cantilevers, and wherein said intermediate conductors include anchor structures from which said cantilevers extend.

17. The apparatus of claim 8, further comprising a substrate that has a major surface, wherein said first and second traces and said conduction paths are supported by said major surface.

18. The apparatus of claim 17, wherein each of said first and second traces is elongated along a length direction that is parallel to said major surface, and each of said traces has a substantially equal thickness normal to said major surface, and said traces have respective widths parallel to said major surface and transverse to the length direction that decrease in opposing directions along said connection span.

19. The apparatus of claim 18, wherein said multiple conduction paths consist of a number N of conduction paths, and said first and second traces have widths that decrease by an amount A/N when moving from one conduction path to an adjacent conduction path along said connection span, where A is a respective cross sectional area magnitude of said first and second traces away from said connection span.

20. A method comprising:

depositing a film on a substrate;

patterning the film to form first and second traces;

simultaneously microfabricating multiple switches on the substrate, such that the switches are configured to form parallel electrical connections along a connection span between the first and second traces, wherein the film is patterned such that the first and second traces have respective cross-sectional areas that decrease in opposing directions along the connection span.

* * * * *